US007390076B2

(12) United States Patent
Ma et al.

(10) Patent No.: US 7,390,076 B2
(45) Date of Patent: Jun. 24, 2008

(54) METHOD OF SEALING NOZZLES

(75) Inventors: Kuo-Tong Ma, Taipei (TW); Yu-Chang Shen, Taipei (TW)

(73) Assignee: Qisda Corporation, Taoyuan (TW)

( * ) Notice: Subject to any disclaimer, the term of this patent is extended or adjusted under 35 U.S.C. 154(b) by 375 days.

(21) Appl. No.: 11/297,345

(22) Filed: Dec. 9, 2005

(65) Prior Publication Data

US 2006/0139403 A1 Jun. 29, 2006

(30) Foreign Application Priority Data

Dec. 13, 2004 (TW) ..... 93138584 A

(51) Int. Cl.
*B41J 2/165* (2006.01)
*B41J 2/135* (2006.01)

(52) U.S. Cl. ..... 347/29; 347/45

(58) Field of Classification Search ..... 347/29, 347/45, 20, 47, 87
See application file for complete search history.

(56) References Cited

U.S. PATENT DOCUMENTS

| | | | | |
|---|---|---|---|---|
| 4,954,002 | A | 9/1990 | Wallis et al. | |
| 5,262,802 | A | 11/1993 | Karita et al. | |
| 5,400,060 | A | 3/1995 | Carlotta | |
| 5,751,323 | A | 5/1998 | Swanson et al. | |
| 5,917,514 | A * | 6/1999 | Higuma et al. | 347/29 |
| 6,257,700 | B1 * | 7/2001 | Aihara et al. | 347/44 |
| 6,409,304 | B1 * | 6/2002 | Taylor | 347/29 |
| 6,547,366 | B2 * | 4/2003 | Sharma et al. | 347/22 |
| 6,588,875 | B1 | 7/2003 | Kleinhammer | |
| 2001/0008408 | A1 | 7/2001 | Silverbrook | |
| 2002/0051037 | A1 | 5/2002 | Silverbrook | |

FOREIGN PATENT DOCUMENTS

| | | |
|---|---|---|
| TW | 166571 | 4/1980 |
| TW | 372219 | 11/1986 |
| TW | 380103 B | 1/2000 |
| TW | 436514 B | 5/2001 |
| TW | 439312 B | 6/2001 |
| TW | 520709 Y | 2/2003 |

* cited by examiner

*Primary Examiner*—Shih-Wen Hsieh
(74) *Attorney, Agent, or Firm*—Muncy, Geissler, Olds & Lowe, PLLC

(57) ABSTRACT

A method of sealing a nozzle. First, a device comprising a chamber, a nozzle, and a nozzle plate is provided, wherein the nozzle plate is installed on the chamber and the nozzle passes through the nozzle plate and connects the chamber. The chamber is then filled with ink. Residual ink on the nozzle plate is then removed by water. After that the nozzle plate is dried, a solution is then coated on the nozzle plate, wherein the solution has higher surface tension than the ink and has smaller contact angle with the nozzle plate than the water. Next, the nozzle plate is dried. Finally, a flexible material is bonded on the nozzle plate to seal the nozzle.

9 Claims, 2 Drawing Sheets

METHOD OF SEALING NOZZLES

BACKGROUND

The present invention relates to a sealing method, and more specifically to a method of sealing a nozzle.

Ink spillage may significantly decrease bonding strength between a nozzle plate and a flexible material of a fluid injection device. Spilled ink may further block nozzles after drying. If the bond therebetween was not set completely, colors expression may be misrepresented due to ink mixing.

Related methods of bonding a nozzle plate and a flexible material are described in the following. For example, as disclosed in U.S. Pat. No. 5,400,060, a low temperature melting material is used as a medium for bonding an uneven nozzle plate and a flexible material. As disclosed in U.S. Pat. No. 5,751,323, an external material of a cartridge is melted to bond a nozzle plate and a flexible material. As disclosed in U.S. Pat. No. 5,262,802, nozzles are directly covered by a sealing member, and as disclosed in U.S. Pat. No. 6,588,875, nozzles are covered by an electrometric seal.

Ink spillage, however, may commonly occur at low pressure or in high temperature environments during transportation or storage. The related methods cannot prevent ink spillage, causing a decrease in bonding strength between a nozzle plate and a flexible material, reducing yield.

Thus, a sealing method which can reduce ink spillage and increase bonding strength between a nozzle plate and a flexible material capable of adapting to environmental variations of transportation and storage is desirable.

SUMMARY

The invention provides a method of sealing a nozzle which provides a solution having higher surface tension than ink and having smaller contact angle with a nozzle plate than water to reduce ink spillage and increase bonding strength of a nozzle plate.

The invention provides a method of sealing a nozzle, comprising the following steps. First, a device comprising a chamber, a nozzle, and a nozzle plate is provided, wherein the nozzle plate is installed on the chamber, and the nozzle passes through the nozzle plate and connects the chamber. Next, the chamber is filled with ink. Residual ink on the nozzle plate is then removed by water. Then, the nozzle plate is dried. Next, the nozzle plate is coated with a solution with higher surface tension than the ink and a smaller contact angle with the nozzle plate than water. After that the nozzle plate is dried, a flexible material is bonded on the nozzle plate to seal the nozzle.

A high energy barrier can be formed on the nozzle plate surface by coating the solution with higher surface tension than the ink thereon. Thus, the ink remains in the nozzle even if external force is applied thereto, greatly reducing ink spillage.

Additionally, adhesion between a nozzle plate and a flexible material can be increased by coating the solution having smaller contact angle with the nozzle plate than water, improving sealing performance, thus effectively increasing yield during transportation and storage. The invention may also be applied to nozzle sealing in ink-jet printers, fax machines, multi function printers, biochips, or micro fuel injection systems.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION

The invention provides a method of sealing a nozzle, comprising the following steps. First, a device comprising a chamber, a nozzle, and a nozzle plate is provided, wherein the nozzle plate is installed on the chamber, and the nozzle passes through the nozzle plate and connects the chamber.

Next, the chamber is filled with ink. Residual ink or attachment on the nozzle plate is then removed by water. Then, the nozzle plate is dried. Next, the nozzle plate is coated with a solution with a higher surface tension than the ink and a smaller contact angle with the nozzle plate than water. The surface tension of the solution is about 25~75 dye/cm, and the contact angle with the nozzle plate thereof is about 15~70°.

The solution is preferably composed of ink additives to avoid altering the ink characteristics. The ink additives comprise organic solvents comprising alcohol, polyalcohol, amino alcohol, pyrrolidone, urea, or urea derivatives. The alcohol comprises methanol, ethanol, propanol, or isopropanol. The polyalcohol comprises dialcohol, trialcohol, or polymer thereof. The amino alcohol comprises triethanolamine. The pyrrolidone comprises methyl pyrrolidone or 2-pyrrolidone. The ink additives further comprise an organic polymer or a surfactant.

After the nozzle plate is dried, a flexible material is bonded on the nozzle plate to seal the nozzle. The flexible material may be blue tape (manufactured by 3M Corporation)

EXAMPLE

Example 1

Figure 1A:
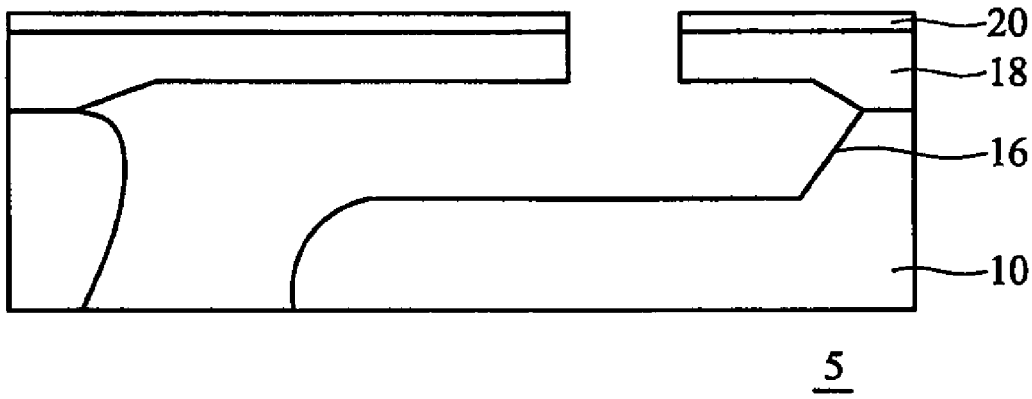
FIGS. 1*a*~1*c* are cross sections of a method of sealing a nozzle of the invention.
Figure 1B:
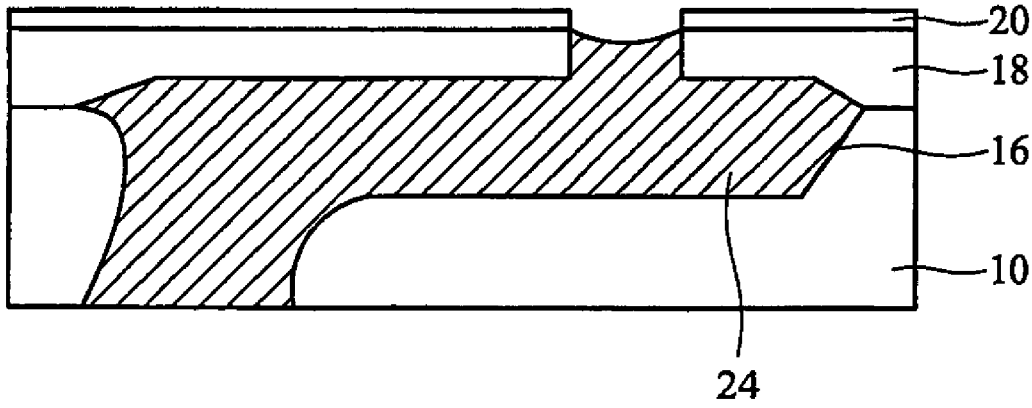
Figure 1C:
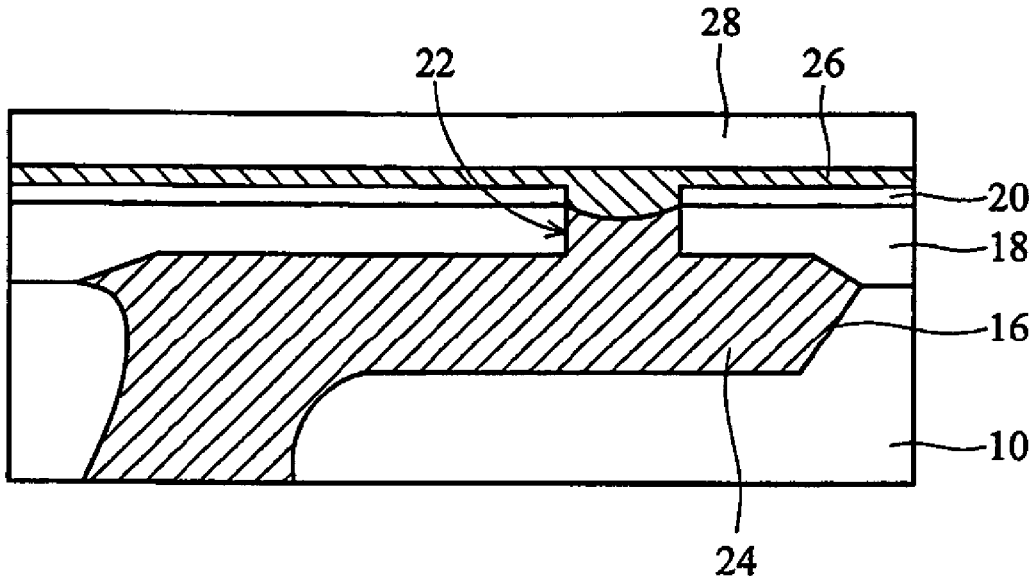

A method of sealing a nozzle is illustrated in FIGS. 1*a*~1*c*. First, referring to FIG. 1*a*, a device 5 comprising a chamber 16, a structural layer 18, a nozzle 22, and a gold nozzle plate 20 was provided, wherein the structural layer 18 and the nozzle plate 20 was installed on the chamber 16 in order. The nozzle 22 was passed through the nozzle plate 20 and the structural layer 18 and connected the chamber 16.

Next, ink 24 was filled into the chamber 16, as shown in FIG. 1*b*. Next, residual ink or outer residue attachment on the nozzle plate 20 was removed by water. Next, the nozzle plate 20 was dried. Next, referring to FIG. 1*c*, a solution 26 was coated on the nozzle plate 20, wherein the solution 26 had a higher surface tension of about 59.8 dye/cm than the ink 24 and had smaller contact angle of about 45° with the nozzle plate than water. A part of solution 26 may be absorbed into the nozzle 22 after 90 seconds due to surface tension.

A higher energy barrier was formed on the surface of the nozzle plate 20 by coating the solution 26 having higher surface tension than the ink 24. Thus, ink 24 remained in the nozzle 22 even when external force was applied thereto, without ink spillage.

The relationship between surface tension and energy barrier is illustrated by the equation (1), wherein $\Delta p$ represents energy barrier, $\sigma$ represents surface tension of fluid, r represents radius of nozzle, and $f(\theta)$ represents the function of the contact angle between the nozzle wall and the fluid.

$$\Delta p=(\sigma/r)f(\theta) \quad (1)$$

To reduce ink spillage, the energy barrier on the nozzle plate must be increased to ensure ink is remained in the nozzle. According to the above equation, when radius (r) is fixed, energy barrier ($\Delta p$) is increased as surface tension ($\sigma$) increases. Thus, the invention coats the solution 26 having higher surface tension than ink 24 on the nozzle plate 20 to increase the energy barrier of the nozzle plate surface to avoid ink spillage.

Additionally, adhesion between the nozzle plate 20 and the flexible material 28 was increased by coating the solution 26 having smaller contact angle with the nozzle plate 20 than water, further improving adhesion.

The relationship between the contact angle and adhesion is illustrated by the equation (2), wherein $W_A$ represents work of adhesion, $\sigma$ represents surface free energy of flexible material, and $\theta$ represents the contact angle between fluid and nozzle plate.

$$W_A=\sigma(l+\cos\theta) \quad (2)$$

According to the above equation, when surface free energy of the flexible material ($\sigma$) is fixed, if the contact angle ($\theta$) becomes smaller, adhesion ($W_A$) may increase. Thus, the invention coats the solution 26 having smaller contact angle with the nozzle plate 20 than water on the nozzle plate 20 to increase the adhesion of the nozzle plate surface, improving adhesion.

After the nozzle plate 20 was dried, a flexible material 28 was bonded on the nozzle plate 20 to seal the nozzle 22. The flexible material 28 was blue tape (330A, 3M).

Example 2

Figure 1D:
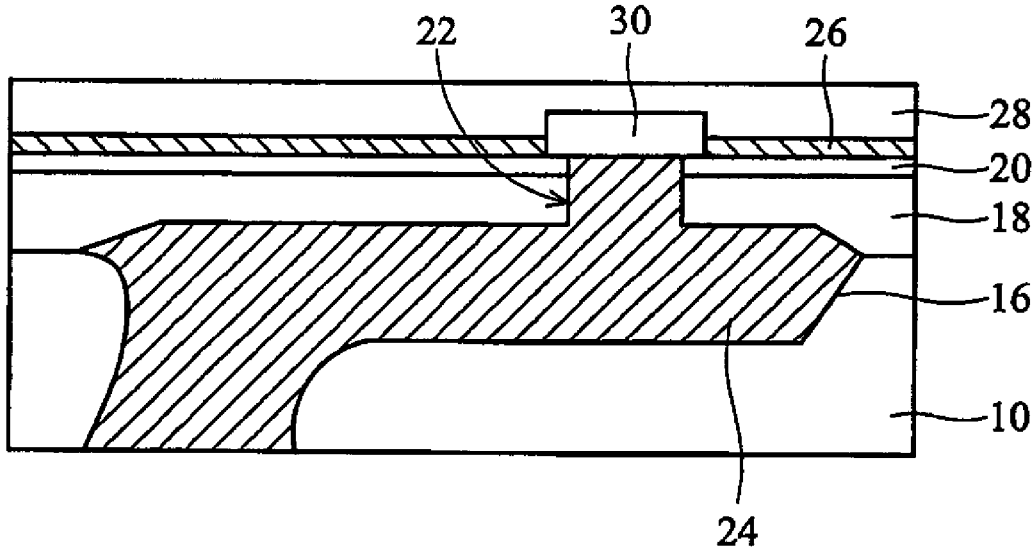
FIG. 1*d* shows a sealing member covered on a nozzle of the invention.

The methods of sealing nozzles illustrated in example 1 and this example are similar. The distinction there between is merely that the nozzle 22 was covered with a sealing member 30 before the solution 26 was coated on the nozzle plate 20 to prevent permeation of the solution 26 into the nozzle 22, as shown in FIG. 1*d*.

Comparative Example

Various solutions were coated on the nozzle plate to compare different degrees of ink spillage. The characteristics of the solutions are described in the following.

(1) Deionized water: surface tension was about 72 dye/cm, and contact angle with nozzle plate was about 70°.

(2) Ink additives: surface tension was about 59.8 dye/cm, and contact angle with nozzle plate was about 45°.

(3) Transparent ink: surface tension was about 27.2 dye/cm, and contact angle with nozzle plate was about 15°.

The characteristics of other materials such as the nozzle plate or the flexible material are also described in the following.

(1) The material of the nozzle plate was gold.

(2) The surface tension of the ink filling into cartridge was about 27.5 dye/cm.

(3) The flexible material was blue tape (Scotch™ Brand No. 330A, 3M)

The test steps are described in the following. After a cartridge was filled with ink, the nozzle plate was washed by each foregoing solution, respectively. The time until ink spillage was calculated after washing. Next, the flexible material was bonded on the nozzle plate. The device was placed for 3 days at 60° C.

The test results are cited in TABLE 1.

TABLE 1

| | Deionized water | Ink additives | Transparent ink |
|---|---|---|---|
| Surface tension (dye/cm) at 25° C. | 72.0 | 59.8 | 27.2 |
| Contact angle with nozzle plate (°) at 25° C. | 70 | 45 | 15 |
| time until ink spillage (sec), after washing | 30 | >180 | >180 |
| yield, after device was placed for 3 days at 60° C. | x | ○ | Δ |

x: yield < 20%;
Δ: 20% < yield < 80%;
○: yield > 80%

The results of Table 1 indicate that ink spillage occurred (30 sec) after washing by deionized water and yield was less than 20%. This is due to the size of which the contact angle (70°) of deionized water with nozzle plate was too large even if deionized water had higher surface tension (72.0 dye/cm) than ink (27.5 dye/cm). Additionally, ink spillage may be delayed (>180 sec) by washing with transparent ink due to its smaller contact angle (15°). The surface tension of transparent ink, however, was too low (27.2 dye/cm), resulting in a mean yield of about 20~80%. Thus, the ink additives having higher surface tension (59.8 dye/cm) than ink and smaller contact angle (45°) with the nozzle plate than water was most preferable. The ink additives delayed ink spillage by more than 180 sec and improved yield to more than 80%.

While the invention has been described by way of example and in terms of preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of sealing a nozzle, comprising:

providing a device comprising a chamber, a nozzle, and a nozzle plate, wherein the nozzle plate is installed on the chamber and the nozzle passes through the nozzle plate and connects the chamber;

filling the chamber with ink;

removing residual ink on the nozzle plate by water;

drying the nozzle plate;

coating a solution on the nozzle plate, wherein the solution has a higher surface tension than the ink and has a smaller contact angle with the nozzle plate than the water;

drying the nozzle plate; and bonding a flexible material on the nozzle plate to seal the nozzle.

2. The method as claimed in claim 1, further comprising covering a sealing member on the nozzle before coating the solution to avoid permeating the solution into the nozzle.

3. The method as claimed in claim 1, wherein the solution comprises ink additives.

4. The method as claimed in claim 3, wherein the ink additives comprise organic solvent, organic polymer, or surfactant.

5. The method as claimed in claim 4, wherein the organic solvent comprises alcohol, polyalcohol, amino alcohol, pyrrolidone, urea, or urea derivates.

6. The method as claimed in claim 5, wherein the polyalcohol comprises dialcohol, trialcohol, or polymer thereof.

7. The method as claimed in claim 1, wherein the solution has surface tension of about 25~75 dyne/cm.

8. The method as claimed in claim 1, wherein the solution has a contact angle with the nozzle plate of about 15~70°.

9. The method as claimed in claim 1, wherein the flexible material comprises a blue tape.

* * * * *